US005090144A

United States Patent [19]

Liu

[11] Patent Number: 5,090,144

[45] Date of Patent: Feb. 25, 1992

[54] CRYSTAL BALL HAVING SWING DOLL WITH COLOR CHANGEABLE EYES

[76] Inventor: J. H. Liu, No. 3, alley 202, Kao-Fon Rd., Hsin-Chu City, Taiwan

[21] Appl. No.: 563,625

[22] Filed: Aug. 7, 1990

[51] Int. Cl.[5] ..... G09F 19/02

[52] U.S. Cl. ..... 40/410; 74/48; 40/411

[58] Field of Search ..... 40/411, 416; 74/50; 72/53.1; 446/298, 297; 84/42.1, 422, 41.1

[56] References Cited

U.S. PATENT DOCUMENTS

| | | | |
|---|---|---|---|
| 2,840,949 | 1/1958 | Faulkner | 446/265 |
| 2,958,878 | 11/1960 | Bryant | 40/411 |
| 3,247,683 | 4/1966 | Dankner | 272/53.1 |
| 4,757,986 | 7/1988 | Hwang et al. | 446/136 |
| 4,875,886 | 10/1989 | Sung | 446/298 |

FOREIGN PATENT DOCUMENTS

| | | | |
|---|---|---|---|
| 1181602 | 11/1964 | Fed. Rep. of Germany | 84/95.2 |
| 468051 | 3/1969 | Switzerland | 84/95.2 |

*Primary Examiner*—Kenneth J. Dorner
*Assistant Examiner*—Cassandra L. Hope
*Attorney, Agent, or Firm*—Larson and Taylor

[57] ABSTRACT

This invention relates to an innovative design of a crystal ball having a swinging doll with color changeable eyes. The crystal ball includes a glass ball mounted on a base and a rotating drive mechanism. The rotating drive mechanism includes a reciprocating gear mechanism that is connected to a swinging plate located beneath the crystal ball in the base. The doll, fixed to the reciprocating swinging plate, will also have a continuous rocking motion. The color of the eyes of the doll changes as a result of such motion, thereby giving more fun to the invention.

15 Claims, 5 Drawing Sheets

CRYSTAL BALL HAVING SWING DOLL WITH COLOR CHANGEABLE EYES

DESCRIPTION OF THE PRIOR ART

The prior art of the crystal balls each has its own individual features. Upon closer examination, most prior art crystal balls have only static changes. For example, the prior art devices do not have interiors or the profiles that are changeable. Recently, a few dolls in the market have been located in which the interior dolls are continuously turning around. However, these crystal balls become very monotonous since such dolls only revolve about a fixed point. There is a need therefore to develop a dynamic landscape that simultaneously has motion and color variations for a doll within the crystal ball.

BRIEF DESCRIPTION OF THE DRAWINGS

The present invention will become more readily apparent from the following description of the preferred embodiment of the present invention taken in conjunction with the accompanying drawing, in which.

DESCRIPTION OF THE PREFERRED EMBODIMENT

Figure 1:
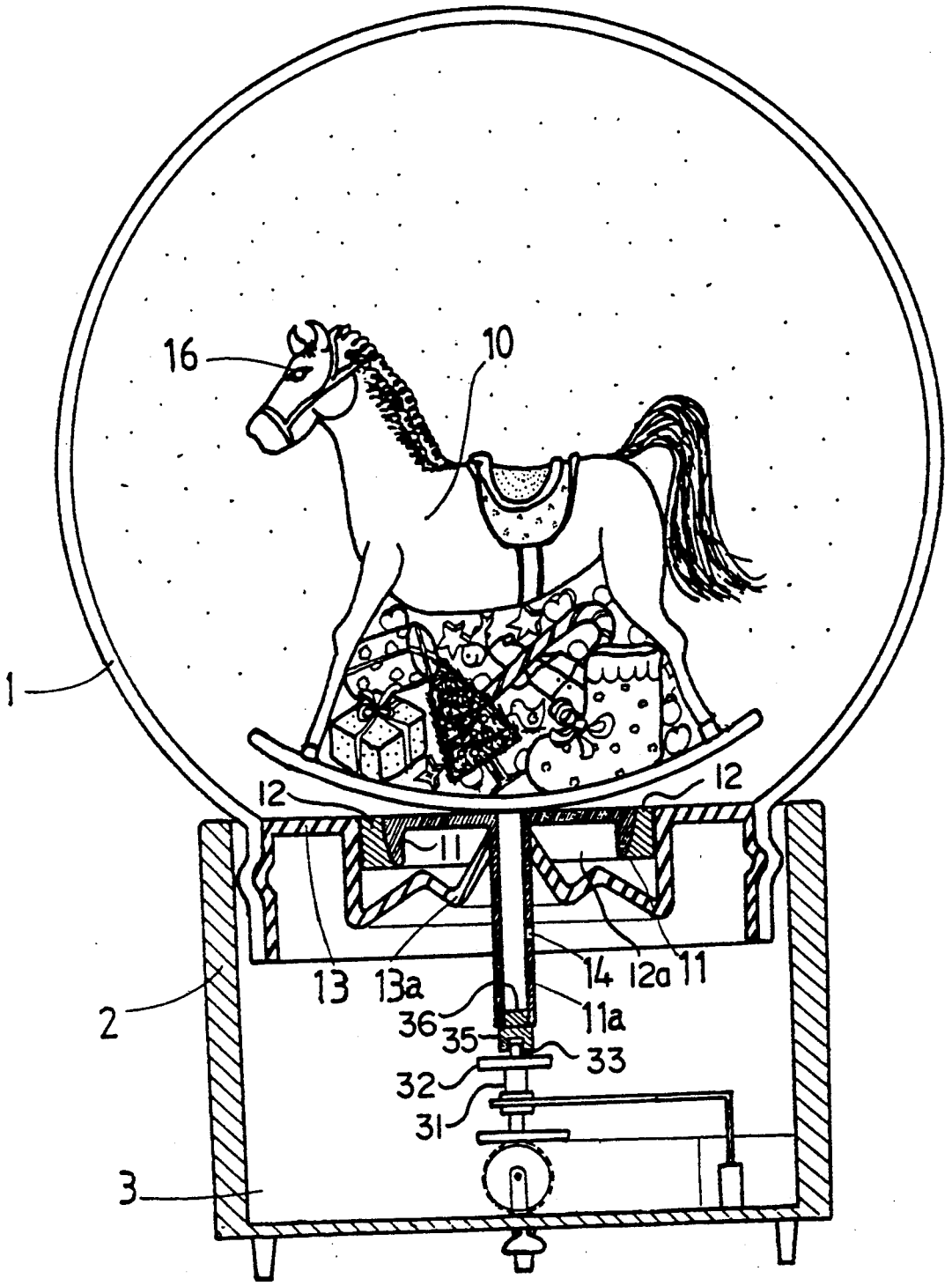
FIG. 1 is a front elevational, cross-sectional view of a preferred embodiment of the present invention.
Figure 2:
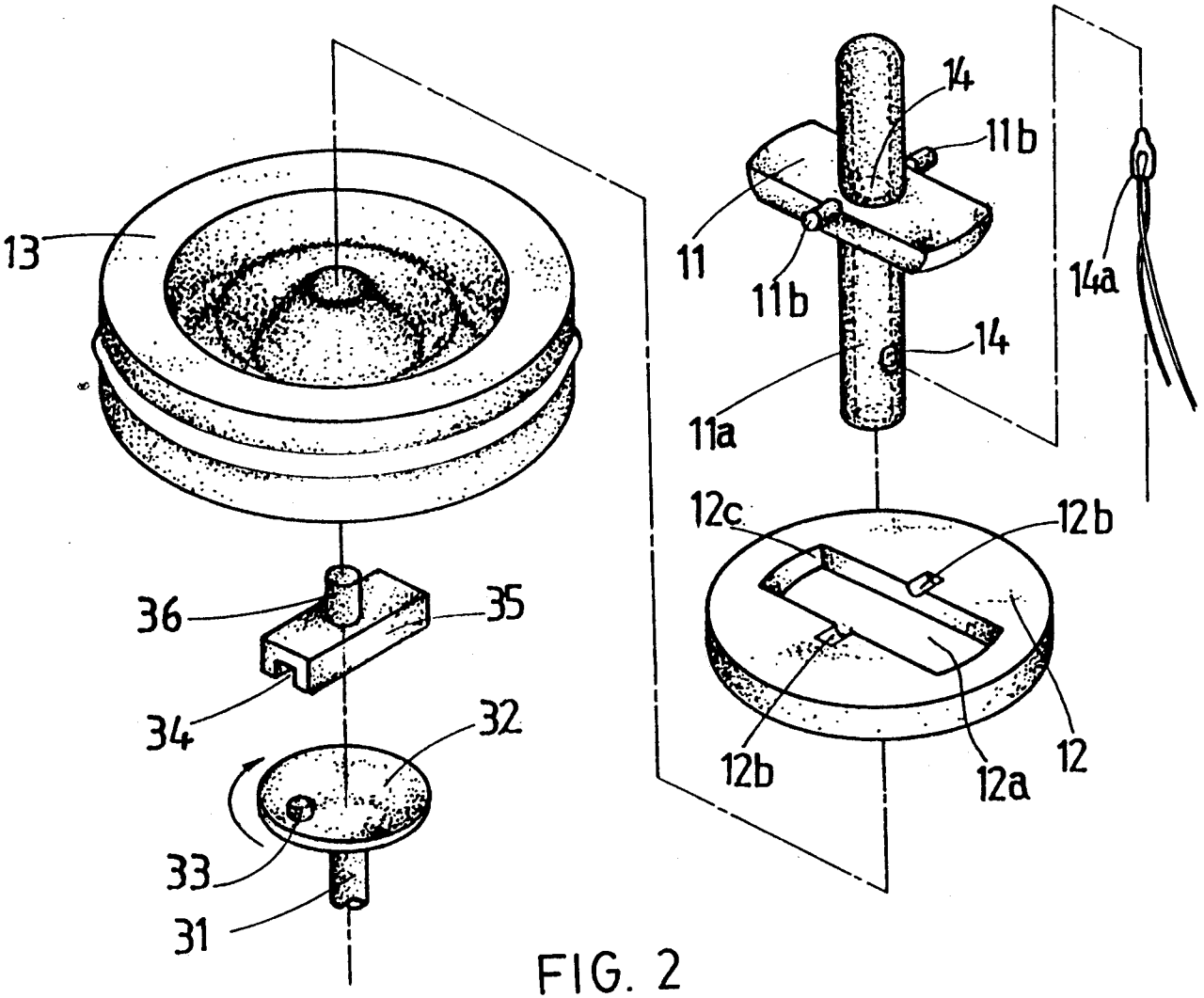
FIG. 2 is an exploded, perspective view of the configuration of the swinging plate of the present invention.

Essentially, the present invention comprises a revolving drive mechanism 3 which can be similar to the spring loaded music box of the prior art using the spring as the drive. Drive mechanism 3 is disposed within a base 2 located below the main portion of a crystal ball 1. The spring (not shown) of drive mechanism 3 rotates an axle 31 and a circulating disk 32 mounted at the top thereof (See FIG. 2). A pivot peg 33 mounted near the edge of circulating disk 32 engages a chute or slit 34 disposed beneath a sliding block 35 (as illustrated in FIGS. 1 and 2). As a result a dancer shaft 11*a* and a swinging plate 11 will rock also since they are connected to block 35. A doll 16 is mounted on dancer shaft 11*a*.

The configuration of the rocking or swinging of the present invention is mainly provided by a swinging plate 11 having one cylindrical, protruding wing 11*b* or pivot axle horizontally disposed at each side. Dancer shaft 11*a*, which is hollow, extends through the central position of swinging plate 11. Swinging plate 11 is mounted upon a fixed plate 12, which in turn is located above a rubber cap 13. On fixed plate 12 there is a slot 12*a* that is sufficiently large enough to accommodate swinging plate 11 to rock or swing about a semi-circular, cylindrical groove 12*b* located at both sides of slot 12*a*. The two protruding wings 11*b* on swinging plate 11 are respectively received in grooves 12*b*. Therefore, when dancer shaft 11*a* is driven, it uses protruding wings 11*b* as the spindle or bearing shaft to have a well-facilitated swinging within groove 12*b* which acts as a journal bearing.

The lower end of dancer shaft 11*a* penetrates or extends through a center orifice of a rubber cap 13. Cap 13 is located below crystal ball 1 and seals the bottom of crystal ball 1 to prevent any overflow or leakage of a fluid contained within ball 1. Another purpose of cap 13 is to support swinging plate 11 and doll 10 whereupon when allowing the penetration and fixation of dancer shaft 11*a* so that even when the crystal ball is placed upside down, swinging plate 11 and doll 10 will not fall off. Furthermore, rubber cap 13 is given a certain resilience due to its mid portion 13*a* (FIG. 1) having corrugated form or shape. Thus, cap 13 will allow dancer shaft 11*a* to have a proper degree of rocking or swinging. The adhesion between rubber cap 13 with crystal ball 1 and dancer shaft 11*a* is obtained by using the generally practiced means of a water-proof glue, which need not be discussed herein. Dancer shaft 11*a*, below the penetration through rubber cap 13, has inserted at its lowest end a protruding jammer 36 in cylindrical shape that is fixed onto an upper portion of a sliding block 35. Jammer 36 is just scarved into the terminal end of hollow dancer shaft 11*a* and is adhered onto it. Sliding block 35 indicates a pillar type and both of its ends, when adhered, are pointed in the same direction as that defined by protruding wings 11*b* of swinging plate 11 as illustrated in FIG. 2. Dancer shaft 11*a* can thus be activated by the pivot peg 33, rotated along with the circulating disk 32 and scarved into the rectangular chute 34 located below said sliding block 35. Swinging plate 11 and doll 10 then will follow along and have a rocking or back and forth motion and/or from and to swinging.

Figure 5:
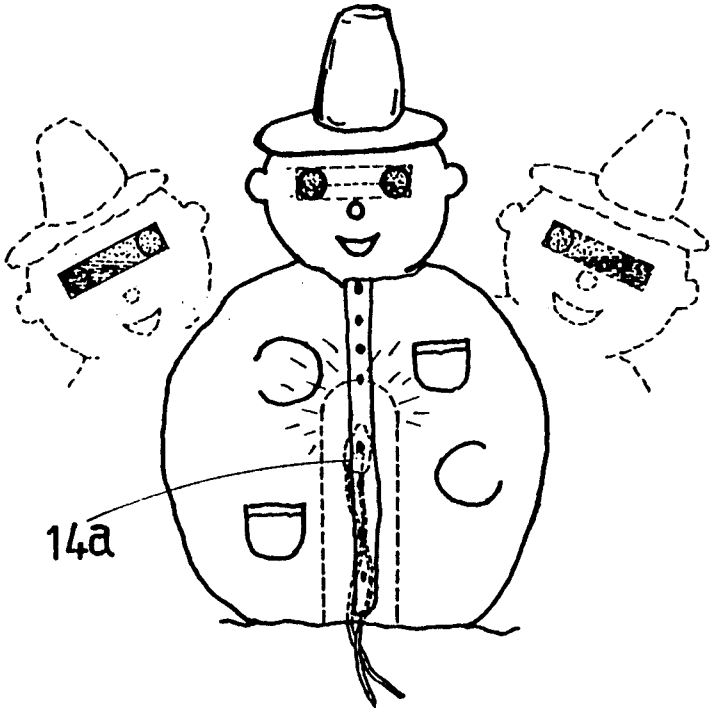
FIG. 5 is the view illustrating the swinging of another doll of the present invention.

The primary purpose of having dancer shaft 11*a* designed with a hollow internal portion, in addition to accommodating jammer 36 of sliding block 35, is so that a mini type of bulb 14*a* can be received therein through a small opening 14 in the side of the lower end of dancer shaft 11*a* (FIG. 2). Bulb 14*a* extends through the hollow portion of dancer shaft 11*a* to the upper end thereof. Thus the location of bulb 14*a* is within the hollow portion of doll 10, as illustrated in FIG. 5. Dancer shaft 11*a* can be either transparent or semi-transparent so that the light emitted from bulb 14*a* further improves the color changing effects of the doll eyes, described below.

Figure 3:
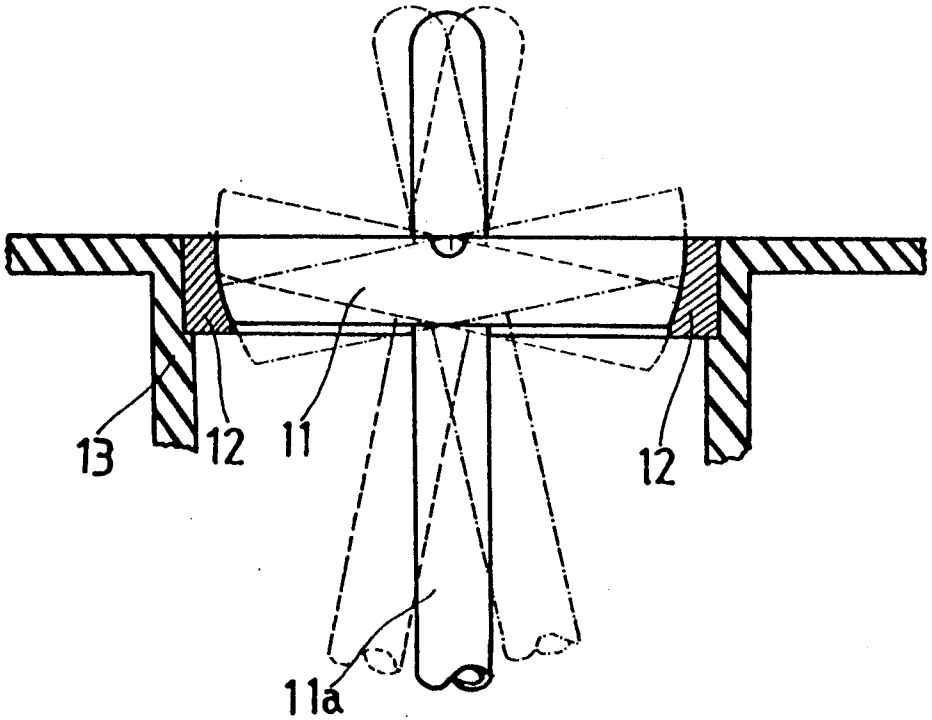
FIG. 3 is a side cross-sectional view of the configuration of the swinging plate of the present invention.

In order to prevent contaminants or small particles within ball 1 (such as the imitations of snow flakes or falling leaves made of plastic grains) from falling into the space between swinging plate 11 and fixed plate 12 thereby interfering with their swinging motion, the protruding wings 11*b* of swinging plate 11 are designed with a cylindrical shape and grooves 12*b* on said fixed plate 12 which receive protruding wings 11*b* are designed with a corresponding semi-cylindrical shape as illustrated in FIG. 2. As a result, disregarding the extend of the motion of swinging plate 11, there will never be a possibility to clog the clearance space between protruding wings 11*b* and grooves 12*b* with particles large enough to cause a problem from within the crystal ball 1. Also, both ends of the swinging plate 11 contacting slot 12*a* of swinging plate 12 have a curvature or sufficient arc (as illustrated in FIG. 3) so that there will be too small of a space or clearance created during their relative swinging.

Figure 4:
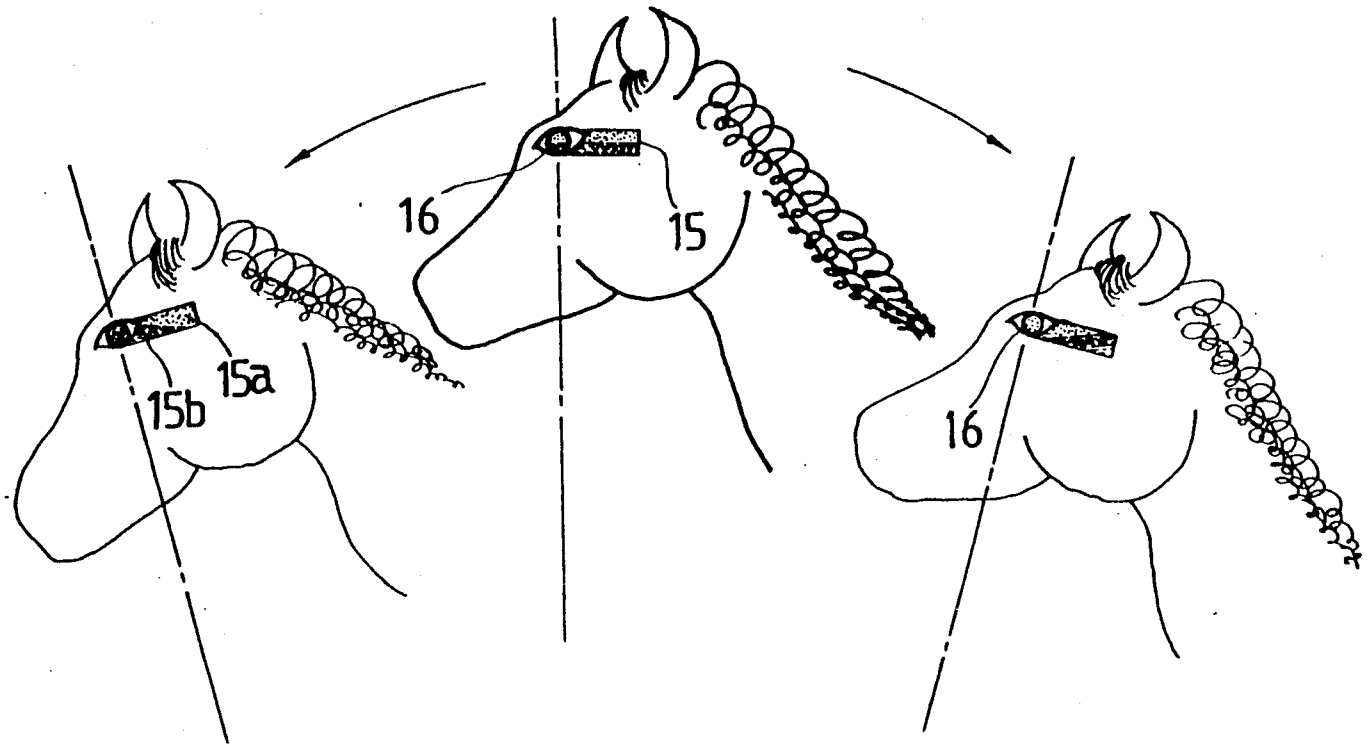
FIG. 4 is a diagrammatic view illustrating the swinging doll of the present invention.

Another feature of the present invention is the eyes of the doll 10. As illustrated in FIG. 4, a pair of glass tubes 15 that are hollow and air-tight contain a fluid, mainly in the form of two different fluids 15*a* and 15*b* which have different colors and specific gravities. Thus, irrespective of how the position of glass tube 15 may be changed, the fluid 15*a* having a smaller specific gravity than that of the fluid 15*b* will always remain at the top of fluid 15*b*. Therefore, once the head of the rocking horse doll 10 rocks back and forth along with the movement of swinging plate 11, the position of the eyeball located at one end of glass tube 15 will also be tilted up and down thereby enabling the color of the eyeball to change as illustrated in FIG. 4. Furthermore, eyeball 16 of the present invention is comprised of a glass bead so that the lighting from within rocking horse doll 10 will cause the eyes of doll 10 to become brighter and clearer as a result of the light focusing effects (same as the convex lens principle).

The style of doll 10 within the present invention can be made as a tumbler or any other shapes as desired (as illustrated in FIG. 5), while the lens for the eyeball (i.e., the glass bead) can be the shape of a star, or ball, or other decorative items to further increase the features of the sparking and clear eyes.

Based on the aforesaid, the present invention by delicately operating a dancer shaft and a swinging plate within the limited space of a base at the bottom of the crystal ball enables the doll within the crystal ball to have a swinging motion quite different from the prior art and provides dual-fluid glass tubes within the eyes of the doll to have various color changes, thereby providing more fun from the present invention.

I claim:

1. A crystal ball having a swinging doll powered by a spring loaded music box, said crystal ball comprising:

a transparent hollow ball having an open neck at the bottom thereof;

a base on which said ball is mounted, the music box being mounted within said base;

a rubber cap having a central orifice mounted within said neck of said ball, a top side facing said ball, and a bottom side facing said base, said rubber cap providing a fluid tight seal with said neck of said ball;

an elongated dancer shaft having a longitudinal bore therein, said shaft extending upwardly through said cap central orifice, said shaft having an upper portion extending above said cap into said ball and a lower portion extending below said cap into said base;

said swinging doll mounted to said upper portion of said dancer shaft;

an elongate swing plate mounted on said dance shaft above said rubber cap, said swig plate including a pair of transversely extending, cylindrical stub axles;

a fixed plate mounted to the side of said rubber cap, said fixed plate having an elongated central slot therein and two transverse, semi-circular grooves on either side of said slot, said slot having a size and configuration such that said swing plate can swing therein and said grooves having a size and configuration such that said stub axles can be received and can pivot therein;

a sliding block rigidly mounted to said lower portion of said shaft below said rubber cap, said sliding block having a groove in the bottom thereof; and means for pivoting said dancer shaft comprising a plate rotated by said spring loaded music box, and an upstanding peg mounted off-center on said plate and received by said sliding block groove such that the rotation of said plate causes reciprocal motion of said sliding block, said dancer shaft, said swing plate, and finally the doll mounted in the ball.

2. A crystal ball as claimed in claim 1, in which there is a liquid inside said crystal ball and particles in said liquid;

wherein said both ends of said swinging plate are closely spaced from corresponding ends of the slot on the fixed plate, such that said particle are unable to pass therebetween.

3. A crystal ball as claimed in claim 2 wherein the doll has eyes and means for changing the color of said doll eyes, said means comprising a glass tube containing a colored fluid.

4. A crystal ball as claimed in claim 1 wherein the doll has eyes and means for changing the color of said doll eyes, said means comprising a glass tube containing a colored fluid.

5. A crystal ball comprising a transparent hollow ball having an open bottom;

a base on which said ball in mounted;

a figurine within said ball;

resilient means having a central orifice and sealingly mounted on said open bottom of said ball so as to provide a fluid tight seal, said resilient means having a top side facing said ball and an opposite, bottom side;

an elongated dancer shaft having an upper portion extending upwardly through said central orifice, said figurine mounted thereon, and a lower portion extending downwardly into said base;

a swing plate mounted on said shaft above said resilient means;

a fixed plate mounted above said resilient means having a slot therein for pivotally mounting said swing plate;

a reciprocating means for reciprocating said dancer shaft;

and means for providing power to said reciprocating means.

6. A crystal ball as claimed in claim 5 in which there is a liquid inside said crystal ball and particles in the liquid;

wherein said swing plate has a cylindrical axle extending outwardly therefrom; and wherein said fixed plate has grooves with a semi-circular cross-section which are adapted to receive said axle with a fit such that the particles cannot enter the space between said axle and said groove.

7. A crystal ball as claimed in claim 6 wherein said swing plate is elongate with opposite ends, each end having a convex shape; and wherein said slot is elongate and is defined by end walls that have a concave shape that corresponds to said convex shape of said swing plate such that the particles cannot enter the space between said swing plate and said slot end walls.

8. A crystal ball as claimed in claim 7 wherein said fixed plate and said swing plate have thicknesses, and the degree of the swing of said swing plate is such that said swing plate end always overlaps said slot end wall.

9. A crystal ball as claimed in claim 5 in which there is a liquid inside said crystal ball and particles in the liquid;

wherein said swing plate is elongate with opposite ends, each end having a convex shape; and wherein said slot is elongate and is defined by end walls that have a concave shape that corresponds to said convex shape of said swing plate such that the particles cannot enter the space between said swing plate and said slot end walls.

10. A crystal ball as claimed in claim 9 wherein said swing plate is elongate with opposite ends, each end having a convex shape; and wherein said slot is elongate and is defined by end walls that have a concave shape that corresponds to said convex shape of said swing plate such that the particles cannot enter the space between said swing plate and said slot end walls.

11. A crystal ball as claimed in claim 5 wherein the figurine has eyes; and further comprising a means for changing the color of said eyes, said means comprising a glass tube containing a colored fluid.

12. A crystal ball as claimed in claim 5 wherein said color changing means fluid comprises a first and a second liquid having different specific gravities such that one fluid floats on top of the other fluid.

13. A crystal ball as claimed in claim 5 wherein said dancer shaft is hollow and can pass light therethrough; and said crystal ball further including means for providing light mounted inside said hollow dancer shaft.

14. A crystal ball as claimed in claim 5 wherein said resilient means comprises a resilient cap, said cap having a mid portion thereof, said mid poritn having a corrugated form.

15. A crystal ball as claimed in claim 8 and further comprising a sliding block mounted to the lower poritn of said dancer shaft, said block having a groove formed therein; and means for pivoting said dancer shaft comprising a rotating plate having an upstanding peg mounted to said rotating plate and adapted to engage said groove such that the rotation of the plate causes reciprocal motion of said sliding block, said dancer shaft, said swing plate, and said figurine.

* * * * *

UNITED STATES PATENT AND TRADEMARK OFFICE

CERTIFICATE OF CORRECTION

PATENT NO. : 5,090,144

DATED : February 25, 1992

INVENTOR(S) : Jian Ho LIU

It is certified that error appears in the above-identified patent and that said Letters Patent is hereby corrected as shown below:

Col. 3, line 50
Claim 1, line 21, change "swig" to --swing--.
Col. 6, line 8
Claim 14, line 3, change "poritn" to --portion--.
Col. 6, line 11
Claim 15, line 2, change "poritn" to --portion--.

Signed and Sealed this

Fourteenth Day of June, 1994

Bruce Lehman

*Attest:*

BRUCE LEHMAN

*Attesting Officer*

*Commissioner of Patents and Trademarks*